United States Patent [19]

Bohle

[11] 4,379,509

[45] Apr. 12, 1983

[54] HIGH EFFICIENCY SORTING APPARATUS

[76] Inventor: Lorenz Bohle, Im Luren 5, 4722 Ennigerloh, Fed. Rep. of Germany

[21] Appl. No.: 225,350

[22] Filed: Jan. 15, 1981

[51] Int. Cl.[3] ..... B07C 5/34

[52] U.S. Cl. ..... 209/598; 209/617; 209/621; 209/632; 209/634; 209/668; 209/672; 209/914; 209/625

[58] Field of Search ..... 209/617, 621, 632, 634, 209/667, 668, 672, 674, 921, 940, 598, 916, 625; 221/268

[56] References Cited

U.S. PATENT DOCUMENTS

| | | | |
|---|---|---|---|
| 1,056,764 | 3/1913 | Naramor | 209/617 |
| 1,492,867 | 5/1924 | Thompson | 209/617 X |
| 2,364,187 | 12/1944 | Birdsall | 209/672 X |
| 3,294,235 | 12/1966 | Pitkin et al. | 209/672 X |
| 3,709,328 | 1/1973 | Mohr | 209/598 X |
| 3,746,166 | 7/1973 | Van Gaalen | 209/625 X |
| 3,997,058 | 12/1976 | Greer | 209/672 X |

*Primary Examiner*—Allen N. Knowles

*Attorney, Agent, or Firm*—Toren, McGeady and Stanger

[57] ABSTRACT

Apparatus for sorting items according to size wherein the items are dropped between a pair of opposed sorting discs having facing sides with the spacing between the sides varying radially of the discs, with withdrawing elements being interposed at various radial locations between the facing sides of the discs for separately receiving the items in accordance with the size thereof.

17 Claims, 4 Drawing Figures

HIGH EFFICIENCY SORTING APPARATUS

BACKGROUND OF THE INVENTION

The present invention relates generally to a sorting machine and more particularly to a machine for sorting items such as dragees (sugar-coated pills), other pills, capsules, or candy of varying sizes with high efficiency.

In devices presently known, products of this type are sorted by machines which jolt the products from a supply funnel by means of a vibration conveyor onto long, cylindrical inclined pairs of shafts or chutes with different directions of rotation. The shafts or chutes have a larger diameter at the upper end than at the lower end thereof. As a result, after sliding on these pairs of shafts, the items to be sorted will fall through depending upon their thickness. Items of desired shape or size are again conveyed by means of vibration action over perforated strainers in order to control the sorting in accordance with diameter. Products of a desired size must cover a long sliding distance on the tracks.

The items are subsequently conducted over several sorting belts so that various operating personnel may undertake visual control of the surface. During this control process, there must be especially identified defects located on the surface of the type which during packaging would potentially cause crushing and consequent destruction of the products, such defects being of the type which cannot be detected during control of the thickness of the items. It will be apparent that such defect detection is especially important with regard to pharmaceutical products such as dragees, pills, tablets or the like which could become useless or even dangerous if crushed or otherwise rendered defective.

Because of the repeated vibration during conveyance, these sorting machines tend to create a noise level which is excessive for operating personnel. Therefore, in many cases the sorting machines are arranged in individual enclosures separately from the sorting belts. Additionally, sorting accuracy depends upon the inclination of a pair of shafts which must be repeatedly adjusted depending upon the curvature of the product. If the products are significantly curved and if the shafts are adjusted too steeply, then incorrect measurements cannot be avoided. The surfaces must be visually checked by the operating personnel and due to human characteristics such as fatigue after long intensive control over several hours, accuracy and consistency cannot be maintained even by changes in operating personnel.

The invention includes among the advantages provided thereby the prevention of health hazards to operating personnel by reduction in noise levels, sometimes by as much as 100%, while at the same time enabling high sorting output. Adjustability during product change need not occur at the expense of sorting accuracy and the invention aims to accomplish achievement of completely mechanical control of the sorting which may replace the visual control otherwise required.

SUMMARY OF THE INVENTION

Briefly, the present invention may be described as apparatus for sorting items according to size comprising a pair of opposed sorting discs having facing sides with the spacing between said sides varying radially of the discs, means for depositing items to be sorted between said facing sides of the sorting discs and means interposed at various radial locations between said facing sides for withdrawing said items separately from between said sorting discs in accordance with the size of said items.

The depositing means of the invention may comprise a supply funnel with several conical outlets with the feed of the items being effected by means of oscillating conveying elements which achieve prevention of bridging in the conical outlets of the supply funnel as well as a uniform feed of the items.

Furthermore, feed discs may be provided from which the items are delivered to the sorting discs. The feed discs will ensure an exact separation and will effect automatic feed of a desired amount in accordance with respective circumferential speed of the discs.

From the pair of feed discs, the items are brought in exact alignment with inclined surfaces of the pair of high efficiency sorting discs under the force of gravity. The items will fall until they establish bilateral contact with the facing sides of the sorting discs in accordance with the thickness of the items. Several desired thicknesses can be sorted out by operation of the withdrawing means which act as outlets from the sorting discs.

The withdrawing means may comprise a plurality of chutes which extend to between the sorting discs various distances. Products of a desired size can be sorted out by one or more perforated discs which may be arranged to receive the items from the withdrawing chutes. The perforated discs may operate to effect a further sorting procedure wherein products which are overly large or overly small may be separated in the rotating perforated discs depending upon their size and contour.

Alternatively, the items may be fed from the withdrawing chutes into a pair of counter-rotating wheels having contour means on the peripheral surfaces thereof which engage the items to be sorted and which separate the items in accordance with contour. In the contour wheels, a half shell of the product surface always scans the surface of the product. The elements with the half shells of the upper wheels are movably arranged. If the product is too large in an area, then the segment with the half shell lifts and releases a sorting out. In addition, the product can be checked for broken pieces with a photoelectric device, such as for instance with an infrared control device.

For the expert, it was surprisingly successful to achieve a removal from a funnel causing low noise. Measurement in free fall is the fastest scanning that can be accomplished without permitting additional accelerative forces to affect the product. The accuracy of the high efficiency sorting discs lies surprisingly at a difference of a few hundredth parts of a millimeter (a few % of a mm).

The perforated disc sorting is essentially noiseless where the drive is concerned with merely product noises occurring. The alternative control by means of contour wheels is also low in noise and, if light materials are used, such as for example plastic or plexiglass, no pressure loads of more than approximately 10 to 15 g result for the product. When using plexiglass, broken pieces as well as products with missing corners may be sorted out with photoelectric means.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

DETAILED DESCRIPTION OF THE PREFERRED EMBODIMENTS

Figure 1:
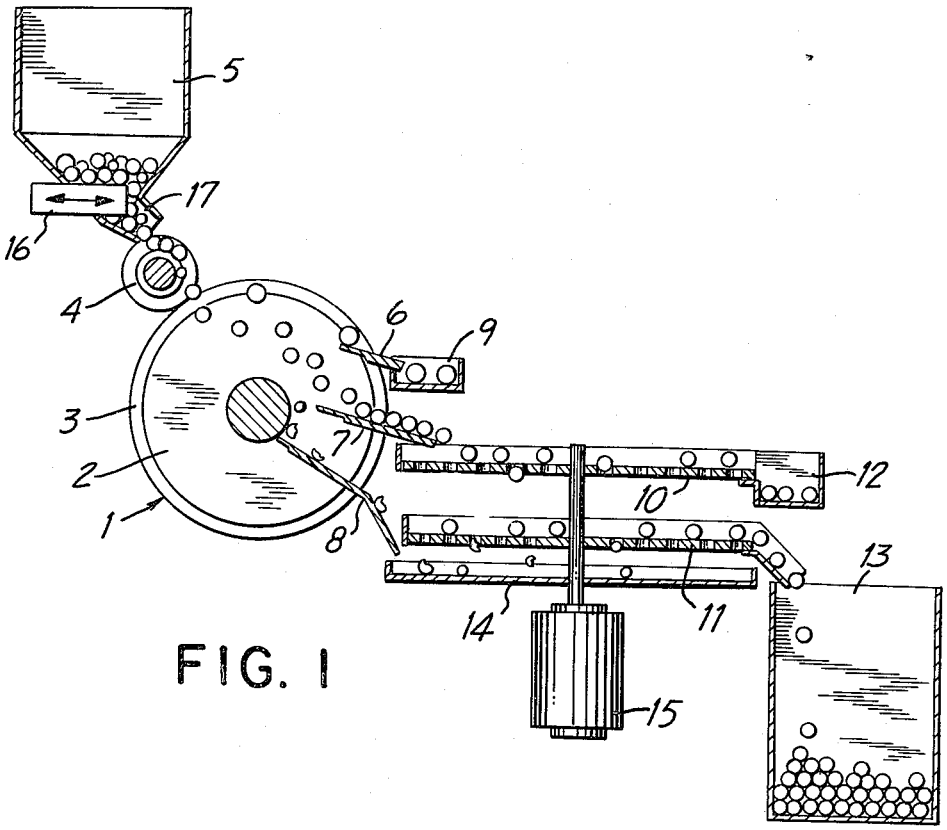
FIG. 1 is a schematic side elevation showing apparatus in accordance with the invention.
Figure 2:
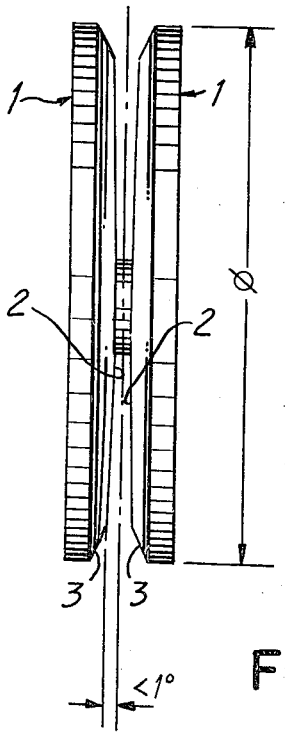
FIG. 2 is an end view showing a pair of sorting discs in accordance with the invention.

Referring now to the drawings, and particularly to FIGS. 1 and 2, there is shown a high efficiency sorting mechanism which is combined with a perforated disc sorting device.

In FIG. 1, a pair of high efficiency sorting discs 1 are provided which, as best seen in FIG. 2, comprise a preliminary sorting surface 3 and sorting surfaces 2 which are arranged in opposed relationship facing each other. Items which are to be sorted by the apparatus are delivered from a funnel 5 and are fed through an oscillating conveying element 16 and a funnel 17 to a pair of feed wheels 4 from which the items are delivered to between the pair of high efficiency sorting discs 1.

One of the pair of feed wheels 4 is rotatable and by controlling the circumferential speed of this feed wheel 4, an exactly dosed amount of the items to be sorted can be fed to between the sorting discs 1 because the output of all sorting machines is influenced by the form and the diameter of the products to be sorted.

Figure 3:
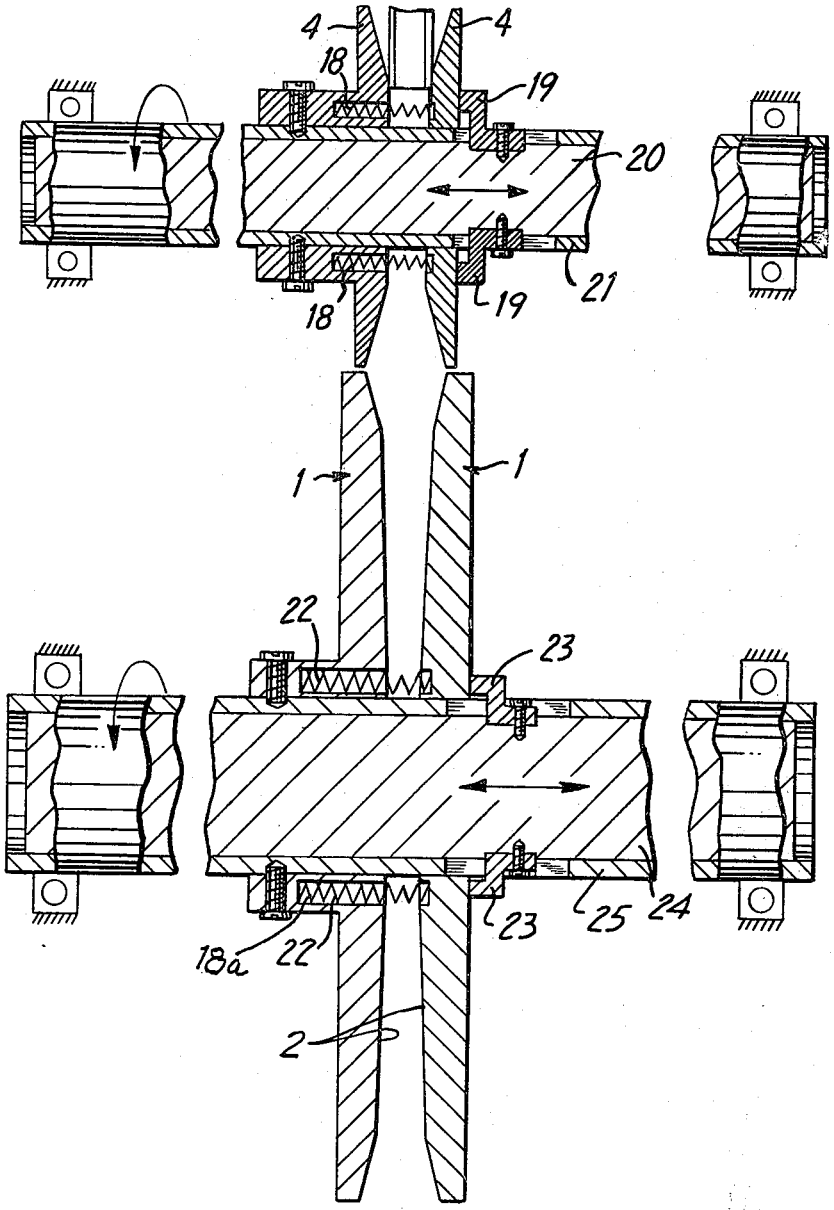
FIG. 3 is a sectional view taken through a pair of feed discs and a pair of sorting discs in accordance with the invention.

The apparatus also includes means for withdrawing the items from between the sorting wheels 1 in accordance with the size of each item. With reference to FIG. 3, it will be seen that the opposed faces 2 of the sorting discs 1 are tapered or slanted and that the spacing therebetween diminishes radially inwardly of the discs. Accordingly, when items to be sorted are dropped between the discs 1, the smaller items will move radially inwardly to a greater distance than larger items.

The withdrawing means comprise a plurality of chutes 6, 7, and 8 which are positioned to extend to between the discs 1 to varying distances. The chute 6 is arranged to receive therein items to be sorted at a radially outermost point. The chute 7 terminates at a point radially inwardly from the chute 6 and the chute 8 extends to the radially innermost point of the withdrawing means. As a result, larger items will be removed by the chute 6 and smaller items will be removed by the chute 8 with the chute 7 serving to sort out and receive items of a desired size. It will be obvious that the chute 8 serves as a device for totally emptying the space between the discs 1 of any of the remaining items to be sorted.

The items sorted out by the chute 6 are collected in a container 9 and the smallest items are delivered by the chute 8 into a container 14. Only items or similar products which are caught and removed by the chute 7 are delivered to a further sorting mechanism which comprises perforated discs 10 and 11. The items are here sorted in accordance with their outline which, in the case of pharmaceutical pills, is usually circular. The pills having too large a diameter are, for example, collected in a container 12 with the pills having a desired dimension being delivered to a container 13. Pills or items which are too small are collected in a container 14. The perforated discs 10 and 11 are driven by a motor 15. The sorting discs 1 are best seen in FIGS. 2 and 3. As seen in FIG. 2, the discs 1 include preliminary sorting surfaces 3, in addition to the sorting surfaces 2, with the sorting surfaces 3 having a steeper inclination.

In FIG. 3, the interaction of the stationary and the movable feed discs 4 is shown exemplified in sectional view. While the stationary disc 4 is drilled onto a hollow shaft 21, the adjustable feed disc 4 is pressed without play by means of compression springs 18 against a support frame 19 of a feeder shaft 20.

The hollow shaft 21 is supported in an axially fixed manner while the shaft 20 is axially adjustable without play and can be simultaneously rotated with the hollow shaft 21. The shaft 21 is formed with a slot to accommodate the support frame 19 and to permit relative axial movement between the shafts 20 and 21 whereby the spacing between the discs 4 may be adjusted to a desired amount.

The feed discs 4 are aligned with respect to the high efficiency sorting discs 1 in such a way that the stationary discs align exactly with each other insofar as the inner scanning surfaces are concerned. The movable discs 4 and 1 are adjusted to the same side. In this manner, it is ensured that the products will reach the high efficiency sorting discs by force of gravity. The construction of the adjustment of the high efficiency sorting discs 1 is arranged as the adjustment of the pair of feed discs 4, so that a shaft 24 and a hollow shaft 25 rotatable therewith but axially movable relative thereto are supported in a manner similar to that as the shaft 20 and the hollow shaft 21. The shaft 25 is provided with a slot through which a support frame 23 of the shaft 24 extends to move the rightmost disc 1 against the force of a spring 18*a* to adjust the spacing between the discs 1.

Figure 4:
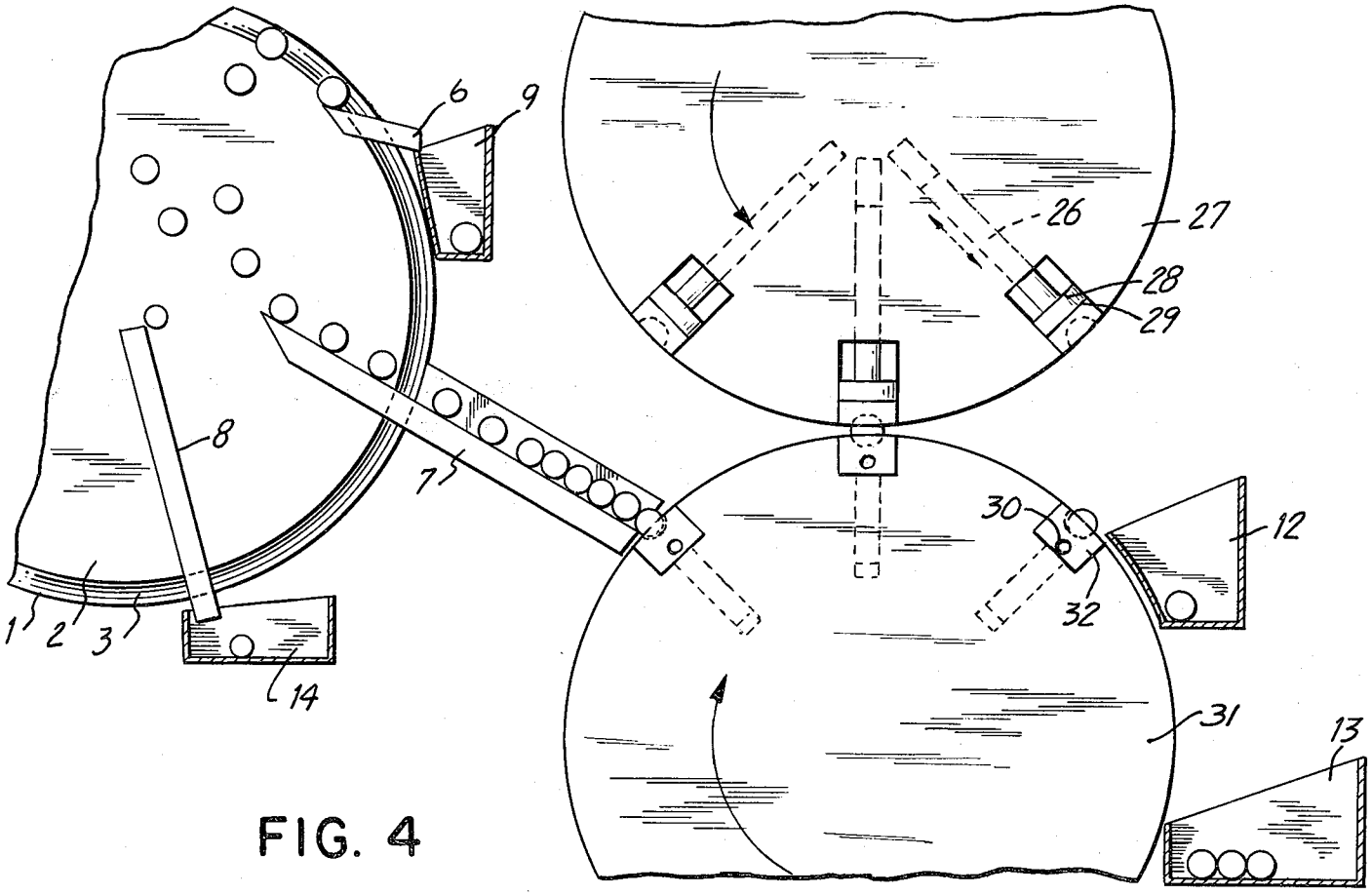
FIG. 4 is a schematic side elevation showing another embodiment of the invention.

In FIG. 4 there is depicted another embodiment of the invention wherein products are removed from a pair of high efficiency sorting discs 1 with the preliminary sorting surfaces 3 and the sorting surfaces 2 by means of scanning or withdrawing devices 6, 7, and 8 into corresponding containers 9 and 14 as well as in a lower contour wheel 31 which rotates with a contour wheel 27 with the same circumferential speed but in opposite directions of rotation. Attached firmly in the wheel 31 are inserted form pieces 32 which comprise half the shape of the specimens to be sorted.

Couterpieces 28 in the upper contour wheel 27 are provided as well as guidances 26 which are movably supported and which can yield by radial movement to the center of the contour wheel 27 in a case where a specimen has a defect.

This movement is sensed or scanned by means of a contact rail 29 without contact. An air jet of very low pressure and of a few milliseconds duration is provided into an opening 30 which enables the sorting procedure for elimination of pills which are too large into the container 12. The scanning accuracy can be selected up to 0.1 mm which is safely below the requirements of packaging tolerances. The products of a desired dimension will fall into the container 13.

While specific embodiments of this invention have been shown and described in detail to illustrate the application of the inventive principles, it will be understood that the invention may be embodied otherwise without departing from such principles.

What is claimed is:

1. Apparatus for sorting items according to size comprising a pair of opposed sorting discs having facing sides with the spacing between said sides varying radially of said discs, means for depositing items to be sorted to between said facing sides of said sorting discs and means interposed at various radial locations between said facing sides for withdrawing said items separately from between said sorting discs in accordance with the size of said items; said depositing means being located to permit said items to fall by force of gravity to between said facing sides of said sorting discs; said depositing means comprising container means, oscillating conveyor means for receiving said items from said container means, and a pair of feed discs having sides generally aligned with the facing sides of said sorting discs, said feed discs being arranged to receive said items from said conveyor means between said facing sides thereof and to deposit said items to between said facing sides of said sorting discs.

2. Apparatus according to claim 1 further comprising a funnel interposed between said oscillating conveyor means and said feed discs, said items being conveyed by means of said oscillating conveyor means from said container means through said funnel into said feed discs.

3. Apparatus according to claim 1 wherein one of said feed discs is affixed to a first hollow shaft and wherein one of said sorting discs is affixed to a second hollow shaft, said apparatus further comprising a first and second slidable shaft each slidable, respectively, in said first and said second hollow shafts with the spacing between said feed discs and said sorting discs being adjustable, respectively, by cooperative engagement between said first hollow shaft and said first slidable shaft and between said second hollow shaft and said second slidable shaft, said slidable shafts being connected with said movable feed disc and movable sorting disc by means of support frames for each movable disc through passages in said hollow shafts.

4. Apparatus according to claim 3 wherein the spacing between said feed discs and said sorting discs is adjusted while excluding bearing plays with compression springs which are prestressed between said discs and act centrally on said first and said second sliding shafts.

5. Apparatus according to claim 1 comprising a plurality of pairs of sorting discs and feed discs, each pair of said sorting discs being arranged adjacent a cooperating pair of feed discs for exact adjustment of the output.

6. Apparatus for sorting items according to size comprising a pair of opposed sorting discs having facing sides formed as flat, planar continuous surfaces inclined relative to each other such that the spacing between said sides varies radially of said discs, means for depositing items to be sorted to between said facing sides of said sorting discs and means interposed at various selected radial locations between said relatively inclined surfaces for withdrawing said items separately from between said sorting discs in accordance with the size of said items in dependence upon the spacing between said relatively inclined surfaces at the radial location where said withdrawing means are interposed, said depositing means being located to permit said items to fall by force of gravity to between said facing sides of said sorting discs, said depositing means comprising container means, oscillating conveyor means for receiving said items from said container means and a pair of feed discs having facing sides generally aligned with the facing sides of said sorting discs, said feed discs being arranged to receive said items from said conveyor means between said facing sides thereof and to deposit said items to between said facing sides of said sorting discs.

7. Apparatus according to claim 6 wherein said withdrawing means comprise a plurality of chutes terminating at various radial locations between said facing sides of said sorting discs.

8. Apparatus according to claim 7 wherein said withdrawing means include perforated disc means receiving said items from said chutes, said perforated disc means comprising perforations of various sizes through which said items may pass to effect a further sorting of said items.

9. Apparatus according to claim 7 wherein said withdrawing means comprises a pair of counter-rotating contour wheels having on their periphery contoured means for receiving from said chutes said items to be sorted for further sorting of said items in accordance with the contour thereof.

10. Apparatus according to claim 7 wherein said chutes are held stationary to effect removal of products from between said pair of sorting discs.

11. Apparatus according to claim 6 further comprising controllable drive means for enabling adjustment of the sorting accuracy of said items.

12. Apparatus according to claim 9 wherein said pair of counter-rotating contour wheels comprise an upper contour wheel and a lower contour wheel with said items to be sorted being always fed into one of said lower contour wheels and one of said upper contour wheels in such a manner that the outline thereof is measured by scanning in always one stationary form piece and one movable form piece.

13. Apparatus according to claim 12 wherein a comparative measurement of the path of said respective form pieces is accomplished with a contact rail and when a settable allowable tolerance is exceeded a test signal to sort out the respective items is obtained.

14. Apparatus according to claim 13 wherein the test signal indicating that a product is overly large may be stored at random in order to be converted into an expulsion function depending upon the circumferential speed of said contour wheels after rotation of said wheels through approximately a range of between 30 to 60 degrees.

15. Apparatus according to claim 14 wherein the expulsion functions permit a mechanical or electrical expulsion from one of said form pieces as well as also a pneumatic expulsion or vacuum elimination.

16. Apparatus according to claim 8 wherein said perforated disc means comprise a plurality of perforated discs and wherein the outline of said items is checked in one or more of said perforated discs and depending upon the number of discs different outlines and diameters are separated.

17. Apparatus according to claim 16 wherein said perforated discs can be arranged horizontally as well as also in an inclined manner.

* * * * *